US006932562B2

(12) United States Patent
Ross

(10) Patent No.: US 6,932,562 B2
(45) Date of Patent: Aug. 23, 2005

(54) SINGLE STAGE, DUAL CHANNEL TURBINE FUEL PUMP

(75) Inventor: Joseph M. Ross, Millington, MI (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 0 days.

(21) Appl. No.: 10/459,993

(22) Filed: Jun. 12, 2003

(65) Prior Publication Data

US 2003/0231953 A1 Dec. 18, 2003

Related U.S. Application Data

(60) Provisional application No. 60/389,676, filed on Jun. 18, 2002.

(51) Int. Cl.[7] ..... F01D 1/12

(52) U.S. Cl. ..... 415/55.1; 415/55.2; 415/55.3; 415/55.4; 415/55.5; 415/55.6; 415/55.7

(58) Field of Search ..... 415/55.1–55.7

(56) References Cited

U.S. PATENT DOCUMENTS 751,209 A 2/1904 Shwarze
945,742 A 1/1910 Boeckel et al.
1,340,091 A 5/1920 Trane
1,689,579 A 10/1928 Burks
2,042,499 A 6/1936 Brady
3,951,567 A 4/1976 Rohs
3,973,865 A 8/1976 Mugele
4,141,674 A 2/1979 Schonwald
4,556,363 A 12/1985 Watanabe et al.
5,141,396 A 8/1992 Schmidt et al.
5,257,916 A 11/1993 Tuckey
5,299,908 A 4/1994 Robbie
5,328,325 A 7/1994 Strohl et al.
5,372,475 A 12/1994 Kato et al.
5,395,210 A 3/1995 Yamazaki et al.
5,486,087 A * 1/1996 Treiber et al. ..... 415/55.1
5,527,149 A 6/1996 Moss et al.
5,536,139 A 7/1996 Yamazaki et al.
5,551,835 A * 9/1996 Yu et al. ..... 415/55.1
5,596,970 A 1/1997 Schoenberg et al.
5,642,981 A 7/1997 Kato et al.
5,702,229 A 12/1997 Moss et al.
5,762,469 A 6/1998 Yu
5,807,068 A 9/1998 Dobler et al.
6,068,456 A 5/2000 Tuckey et al.
6,102,653 A 8/2000 Marx
6,113,363 A 9/2000 Talaski
6,132,185 A 10/2000 Wilhelm
6,152,686 A * 11/2000 Neidhard et al. ..... 415/55.5
6,152,687 A 11/2000 Wilhelm et al.
6,152,688 A * 11/2000 Staab et al. ..... 415/55.5
6,162,012 A 12/2000 Tuckey et al.
6,227,819 B1 5/2001 Gettel et al.
6,231,300 B1 5/2001 Wilhelm et al.
6,231,318 B1 5/2001 Cotton et al.

(Continued)

*Primary Examiner*—Theresa Trieu
(74) *Attorney, Agent, or Firm*—Reising, Ethington, Barnes, Kisselle, P.C.

(57) ABSTRACT

A single stage, dual channel turbine fuel pump for use in a vehicle fuel delivery system, generally including a lower casing, an upper casing, an impeller and a motor. Both the lower and upper casings have a pair of concentric, annular grooves formed on their surfaces, where the two lower annular grooves are in fluid communication with a fuel passage inlet and the two upper annular grooves are in fluid communication with a fuel passage outlet. Rotation of the impeller causes a portion of the incoming fuel to be diverted into an inner lower groove and another portion into an outer lower groove. Once in the lower grooves, the fuel communicates with other parts of the pumping chamber such that it fills the upper grooves as well. Generally independent, helical fuel flow patterns are formed which cause the fuel to become pressurized as it flows from the inlet to the outlet. These helical fuel flow patterns allow for axial communication between vane pockets and corresponding grooves, but do not allow for radial communication.

99 Claims, 7 Drawing Sheets

U.S. PATENT DOCUMENTS 6,302,639 B1 10/2001 Endler et al.
6,309,173 B1 10/2001 Marx
6,402,460 B1 6/2002 Fischer et al.
6,422,808 B1 7/2002 Moss et al.
6,425,734 B2 7/2002 Marx
6,435,810 B1 8/2002 Fischer et al.
6,439,833 B1 8/2002 Pickelman et al.
6,443,691 B1 9/2002 Nather
6,443,693 B1 9/2002 Eck
6,447,242 B1 9/2002 Wilhelm
6,454,520 B1 9/2002 Pickelman et al.
6,454,521 B1 9/2002 Anderson et al.
6,464,450 B1 10/2002 Fischer
6,471,466 B2 10/2002 Marx et al.
6,481,958 B1 11/2002 Wilhelm et al.
6,497,552 B2 12/2002 Kobayashi et al.
6,499,941 B1 12/2002 Fischer
6,503,049 B2 1/2003 Marx et al.
6,517,310 B2 2/2003 Marx et al.
6,527,506 B2 3/2003 Pickelman et al.
6,533,538 B2 3/2003 Aslam et al.
6,540,474 B2 4/2003 Marx et al.
6,638,009 B2 * 10/2003 Honma ..... 415/55.1
6,702,546 B2 3/2004 Takagi et al.
2002/0021961 A1 2/2002 Pickelman et al.
2002/0168261 A1 11/2002 Honna

* cited by examiner

SINGLE STAGE, DUAL CHANNEL TURBINE FUEL PUMP

REFERENCE TO RELATED APPLICATION

Applicant claims the benefit of U.S. Provisional Application No. 60/389,676, filed Jun. 18, 2002.

TECHNICAL FIELD

This invention relates generally to a turbine fluid pump, and more particularly, to a multi-channel turbine fuel pump for use in a vehicle fuel delivery system.

BACKGROUND OF THE INVENTION

Electric motor driven turbine pumps are customarily used in fuel systems of an automotive vehicle and the like. These pumps typically include an external sleeve which surrounds and holds together an internal housing adapted be submerged in a fuel supply tank with an inlet for drawing liquid fuel from the surrounding tank and an outlet for supplying fuel under pressure to an internal combustion engine of the vehicle. A shaft of the electric motor concentrically couples to and drives a pump impeller having an array of circumferentially spaced vanes disposed about the periphery of the impeller. An arcuate pumping channel carried by the housing substantially surrounds the impeller periphery and extends from an inlet port to an outlet port at opposite ends. Liquid fuel disposed in pockets defined between adjacent impeller vanes and the surrounding channel develops pressure through a vortex-like action induced by the three dimensional profile of the vanes and the rotation of the impeller.

Typically, impeller-type turbine fuel pumps have a stationary guide ring which strips fuel from the moving impeller vanes and diverts the fuel through an outlet port. The channel is located radially outward from the impeller vanes and radially inward from a substantial portion or trailing segment of the guide ring. In addition, the channel is located axially or laterally outward from both sides of the impeller at the circumferential array of vanes. In other words, the channel not only side-flanks or communicates axially with the impeller at the vane location from both sides, it also communicates with the vane pockets radially. A smaller portion, or striper segment of the guide ring, is disposed circumferentially between the inlet and outlet ports and is close to the impeller for striping the moving vanes of high pressure fuel, thereby, preventing the fuel at the outlet port from bypassing the fuel pump outlet and exiting back into the low pressure inlet port. Three examples of fuel pumps of this type are illustrated in U.S. Pat. No. 5,257,916 issued Nov. 2, 1993 to Tuckey, U.S. Pat. No. 6,068,456 issued May 30, 2000 to Tuckey et al. and U.S. Pat. No. 6,227,819 B1 issued May 8, 2001 to Gettel et al., each of which is assigned to the present assignee and is incorporated herein by reference.

A second type of turbine pump, such as that illustrated in U.S. Pat. No. 5,702,229 issued Dec. 30, 1997 to Moss et al. and incorporated herein by reference, has concentric dual circumferential arrays of vanes spaced radially apart by a mid-hoop or ring of the impeller, wherein both arrays communicate with a common channel. Similar to the first type of pump previously described, the outer array of vanes of this pump type project substantially radially outward from the periphery of the impeller toward a stationary guide ring. With this configuration, the fuel flows helically around the mid-hoop and through the channel. That is, the fuel flows about the mid-hoop as it is simultaneously circulating around the channel from an inlet to an outlet. Unfortunately, fuel flow cavitation within the pump, especially during hot fuel pumping conditions, continues to be a challenge.

A third type of turbine pump, as illustrated in U.S. Pat. No. 5,642,981 issued Jul. 1, 1997 to Kato et al. and incorporated herein by reference, is similar to the first example previously described, except that multiple pumps are arranged in series and powered by a common motor. Such pumps are better known as multi-stage pumps, or pumps having first and second stages, wherein the first stage (low pressure pump) feeds or flows fuel into a second stage (high pressure pump), thus being of a regenerative pump design. Unfortunately, multi-stage pump designs are expensive to manufacture and have an increased power consumption rate when compared to single stage designs.

Other types of turbine fuel pumps, such as that illustrated in U.S. Publication No. 2002/0021961 A1 published Feb. 21, 2002 to Pickelman et al. and U.S. Pat. No. 5,807,068 issued Sep. 15, 1998 to Dobler et al., both of which are incorporated herein by reference, do not utilize guide rings but instead have a peripheral hoop that is a unitary part of the impeller. The hoop engages the peripheral, radially outward distal ends of a circumferential array of impeller vanes. With this orientation, the impeller pockets only communicate with grooves of the channel in a lateral or axial direction. That is, communication between the impeller pockets and the channel is solely axial, or side-flanking. In contrast, the first and second types of turbine pumps have pockets that communicate with the channel in both an axial and a radial manner.

Despite the variety of turbine-type pumps and significant improvements in the design and construction of turbine fuel pumps on the market today, they are still somewhat inefficient. The efficiencies are generally between about 35%–45%, and when combined with a typical electric motor having an efficiency of about 45%–50%, the fuel pumps have an overall efficiency of between 16%–22%, in general. Higher flow and pressure requirements in the fuel pumping industry are exceeding the capabilities of conventional 36–39 mm diameter regenerative turbine fuel pumps. To increase fuel output and pressure, pumps must operate at higher speeds which aggravates cavitation concerns. Higher speed results in armature viscous drag (lost efficiency), noise and commutator wear. Maximum flow output under hot conditions is around 150 liters per hour for a conventional, single stage, turbine pump. Conventional alternatives to improve hot fuel flow are adding multi-pressure stages to the turbine pump, or oversizing the first stage of a two stage pump to accommodate a 30%–40% flow loss typical for regenerative pumps. However, such alternatives are costly and have an increase in power consumption, thus, which in turn decreases pumping efficiency.

SUMMARY OF THE INVENTION

The above-noted shortcomings of prior art fluid pumps are overcome by the turbine fluid pump assembly of the present invention, which, according to one embodiment, generally includes a lower casing, an upper casing, an impeller cavity, an electric motor and an impeller. The lower casing has a fluid inlet passage and first and second lower annular grooves; similarly, the upper casing has a fluid outlet passage and first and second upper annular grooves. The impeller has a first vane array that communicates with the first lower and upper annular grooves, and a second vane array that communicates with the second lower and upper annular grooves, such that rotation of the impeller causes a portion of the incoming fluid to enter the first lower annular groove and a portion to enter the second lower annular groove.

Objects, features and advantages of this invention include providing a turbine fluid pump assembly that has an improved pump efficiency, an increased displacement or output without loss of pumping efficiency or adding of additional components, improved hot fuel performance at high flow rates over a wide pressure range, that does not require adding additional components as with conventional multi-stage designs, has a higher efficiency then conventional single stage and dual stage designs, is easier to manufacture than multi-stage pumps, has a flat performance curve through various pressures and voltages, and where multiple stages can be added without significant cost or complexity, to name but a few. Furthermore, the design is relatively simple and economical to manufacture, and has a significantly increased useful life in service.

BRIEF DESCRIPTION OF THE DRAWINGS

These and other objects, features and advantages of the present invention will be apparent from the following detailed description of the preferred embodiments and best mode, appended claims and accompanying drawings, in which:

DETAILED DESCRIPTION OF THE EMBODIMENT

Figure 1:
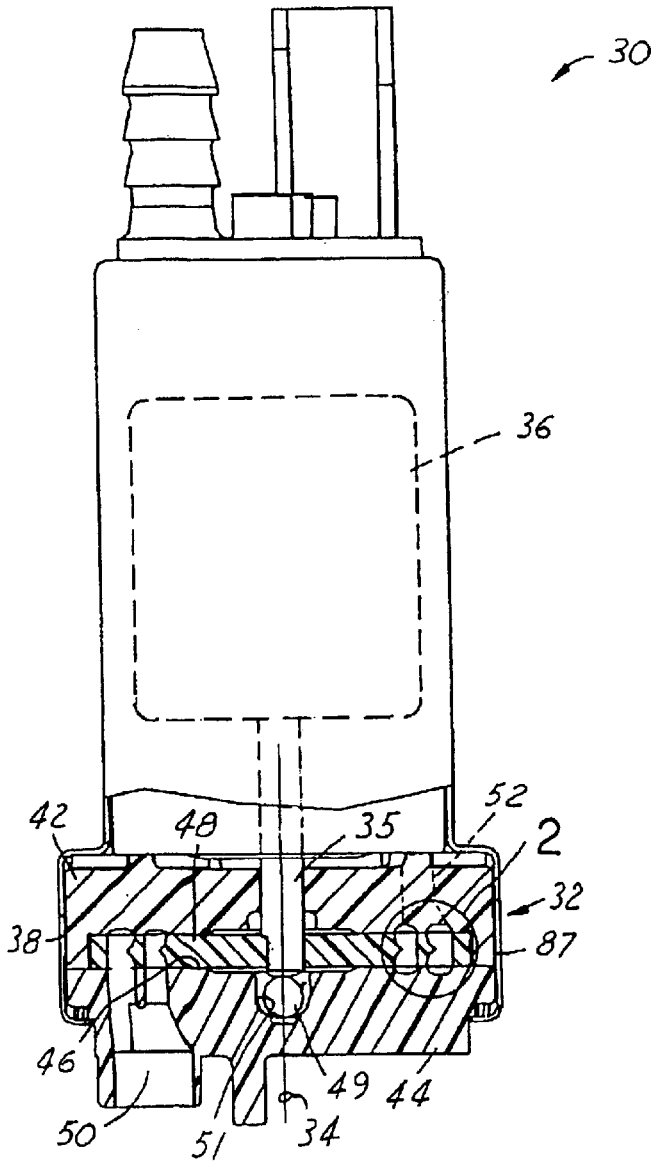
FIG. 1 is partial cross-sectional view of an embodiment of the turbine fluid pump assembly of the present invention.

FIG. 1 illustrates an embodiment of the turbine fuel pump assembly 30 of the present invention, which has a dual side-channel pumping section 32 with an impeller that is preferably powered or rotated on an axis of rotation 34 by an electric motor 36. Pump assembly 30 can be applied to any number of a variety of fluid pumping applications but preferably and for purposes of description, is utilized in an automotive fuel delivery system where the pump assembly is typically mounted in a fuel tank of a vehicle having an internal combustion engine, not shown. An outer housing or sleeve 38 of the pump assembly 30 supports the electric motor 36 and a pumping section 32 in an upright position. In use, typically the axis of rotation 34 extends in a substantially vertical orientation, with respect to the pumping section 32 which is disposed below the motor 36.

The pumping section 32 includes an upper casing 42 and a lower casing 44, which are held together externally and generally encircled by the outer housing 38. An impeller cavity 46 is defined between, as well as being disposed substantially concentric to, the upper and lower casings 42, 44, and carries an impeller 48 of the present invention which rotates about the axis 34. A rotor (not shown), an integral shaft 35 of the motor, and impeller 48 all co-rotate about the axis of rotation 34. The shaft 35 projects downward through the upper casing 42, is fixedly coupled to and projects through the impeller 48, and bears against a bearing 49 that is located in a blind bore 51 in the lower casing.

A fuel inlet passage 50 communicates through the lower casing 44 in a substantially axial direction, through which low pressure fuel flows upward from a fluid reservoir or surrounding fuel tank (not shown) to the impeller cavity 46. Similarly, the upper casing 42 carries a fuel outlet passage 52 (shown in phantom), which provides a passage for pressurized fuel to flow in an axially upward direction out of the cavity 46. Inner and outer circumferential vane arrays 56A, 56B of impeller 48 respectively propel the fuel through circumferentially extending inner and outer pumping chambers 54A, 54B, which are primarily deposed between upper and lower casings 42, 44. The inner and outer vane arrays 56A, 56B are radially aligned with inner and outer pumping chambers, respectively, which generally extend for an angular extent of about 300–350°, or in any case, less than 360°. The pumping chambers 54A and 54B extend about the rotational axis 34 from the inlet passage 50 to the outlet passage 52. There is generally no, or only a limited amount, of cross fluid communication between the inner and outer pumping chambers 54A, 54B. Very limited cross fluid communication between the pumping chambers may be desirable where fuel is needed to act as a lubricant or a fluid bearing between the moving surfaces.

Figure 2:
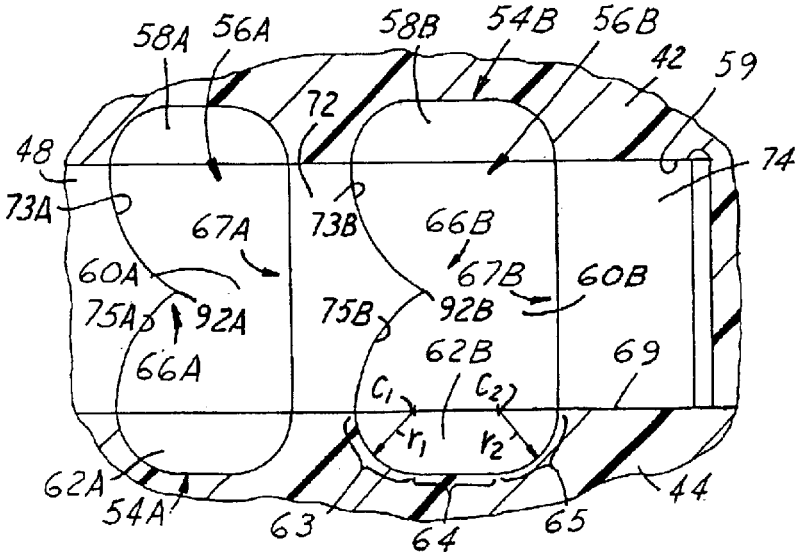
FIG. 2 is a partial enlarged view of the inner and outer pumping chambers of the turbine fluid pump assembly shown in FIG. 1.

With specific reference now to FIG. 2, the inner and outer pumping chambers 54A and 54B respectively include upper grooves 58A, 58B, each of which is formed in a bottom surface 59 of the upper casing 42, lower grooves 62A, 62B, each of which is formed in a top surface 69 of the lower casing 44, and vane pockets 60A, 60B which are formed between vanes on the impeller such that they are in fluid communication with both the upper and lower grooves. Stated differently, the circumferentially extending inner pumping chamber 54A includes upper groove 58A formed in upper casing 42, vane pocket 60A formed within impeller 48, and lower groove 62A formed in lower casing 44; all of which are in fluid communication with each other and are radially aligned such that they circumferentially extend together. In this particular example, upper and lower grooves 58A and 62A are symmetrically shaped and sized, however, they could be non-symmetrically designed as well. The foregoing description of the inner pumping chamber 54A equivalently applies to the outer pumping chamber 54B, which includes upper groove 58B, vane pocket 60B, and lower groove 62B, and is located at a position that is radially outward of the inner pumping chamber. The outer pumping chamber 54B shown in FIG. 2 has a cross-sectional shape that is larger than that of the inner pumping chamber 54A; the unequal size of the two pumping chambers allows for a more efficient impeller. This is because the inner pumping chamber 54A operates at a lower tangential velocity and a higher pressure coefficient than the outer pumping chamber 54B (due to the smaller radius and the shorter circumferential length of the inner pumping chamber). In order to reduce leakage or backflow in the inner chamber, as well as to maximize output flow, the inner pumping chamber 54A requires a smaller cross-sectional area when compared to the outer pumping chamber 54B, both of which are operating at the same rotational speed. There is a trade off, however, between reducing the area of the inner pumping chamber to minimize leakage and maximizing the output flow of that chamber.

The upper and lower grooves 58A, 58B and 62A, 62B are concentric, arcuate grooves that each circumferentially extend around a surface of the upper and lower casings, respectively, such that they open into the impeller cavity 46. Each of these grooves preferably has an oval or elliptical cross-sectional shape, as opposed to a semi-circular cross sectional shape, as commonly seen on prior art pumps. For purposes of clarity, the following description of the shape of the grooves will be provided with specific reference to one of the grooves, but equally applies to the remaining grooves as well. The oval cross-sectional shape of the grooves is comprised of a first radial section 63, a linear or flat section 64, and a second radial section 65, and can increase the efficiency of the pump by reducing the effect of dead or stagnate zones in the pumping chambers where fuel stalls and does not adequately flow. This phenomenon sometimes occurs in semi-circular cross sectional grooves where the groove is too deep, which causes fuel to collect and sit at the bottom of the groove instead of circulating with the rest of the fuel flowing through the pumping chamber. The two radial sections 63, 65 are semi-circular portions of the groove, and may have radii (designating $r_1$ and $r_2$) of a common length or they may have radii with differing lengths. Likewise, the length of the flat section may be uniform amongst the different grooves, or its length may vary with respect to the length of the individual radial sections. In a preferred embodiment, the flat section 64 has a length of between 0.25 mm–1.00 mm. Due to the intervening flat section 64, center points $C_1$ and $C_2$, which correspond to radii $r_1$ and $r_2$, are separated by a certain distance. This distance may vary to suit the particular performance needs of the pump, and can be a function of one of the other dimensions of the grooves. For instance, either the length of flat section 64 or the distance separating the center points may be defined as a function of the length of $r_1$ and/or $r_2$. The upper and lower grooves 58A, 58B and 62A, 62B, which are stationary during operation as they are formed in the upper and lower casings 42, 44, interact with the circulating vane arrays, which will now be described in greater detail.

The vane pockets 60A and 60B are part of the impeller 48 and are formed between adjacent vanes in the inner and outer vane arrays 56A and 56B, respectively. Both the inner and outer vane pockets are open on both their upper and lower axial ends, such that they are adjacent surfaces 59, 69 and are in fluid communication with the upper and lower grooves. Furthermore, the inner vane pocket includes a surface 66A and the outer vane pocket includes a surface 66B, each of which is located on a radially inward side of the vane pocket and includes a circumferential ridge or rib 92A, 92B, respectively. Each of the vane pockets also includes a surface 67A, 67B that is located on the radially outward side of the vane pocket and is flat or extends in an axially straight line. Surfaces 66A and 66B are each partially partitioned by the ridges 92A, 92B such that curved surfaces 73A, 73B are formed on the upper axial halves of surfaces 66A and 66B, and curved surfaces 75A, 75B are formed on the lower axial halves of surfaces 66A and 66B. It follows, that the inner pumping chamber 54A includes a vane pocket 60A having a radially inward surface 66A with a ridge 92A. That ridge partitions surface 66A such that upper and lower curved surfaces 73A and 75A are formed. These curved surfaces may be semi-circular in shape and preferably have a radius equal to that of the first radial section 63 of the corresponding groove. Accordingly, each curved surface 73A, 75A extends away from the ridge 92A in an axial direction towards the upper and lower grooves, respectively, and continues across the small gap separating the grooves from the vane pocket. This continuation causes the curved surfaces 73A and 75A to effectively join with the first radial sections 63 of the grooves 58A and 62A, respectively, thus forming a larger, combined semi-circle or arcuate surface that extends from the ridge to the flat section 64. Of course, other pumping chamber arrangements could also be used, such as where the ridge culminates in a rounded, flat or blunt end, as opposed to the pointed end shown in the drawings. Furthermore, the grooves could be longer in the radial dimension than are the corresponding vane pockets, etc.

Figure 3:
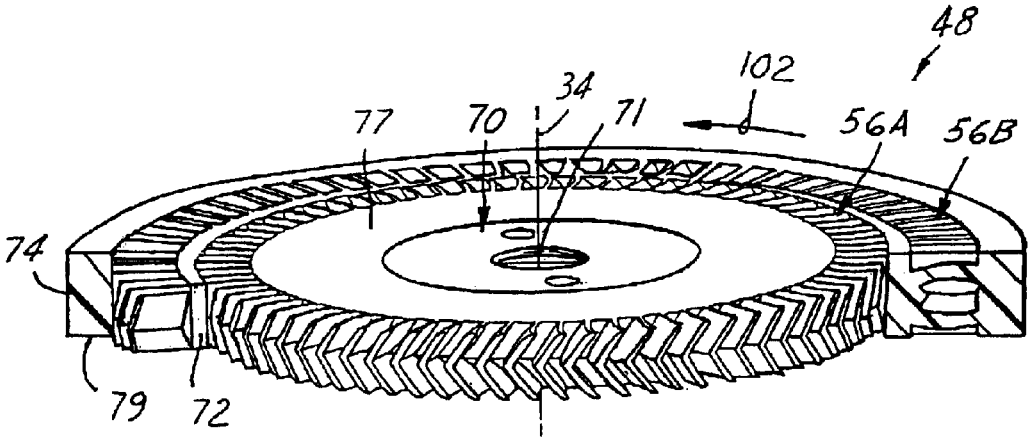
FIG. 3 is a perspective view of the impeller shown in FIG. 1 with portions removed to show internal detail.
Figure 4:
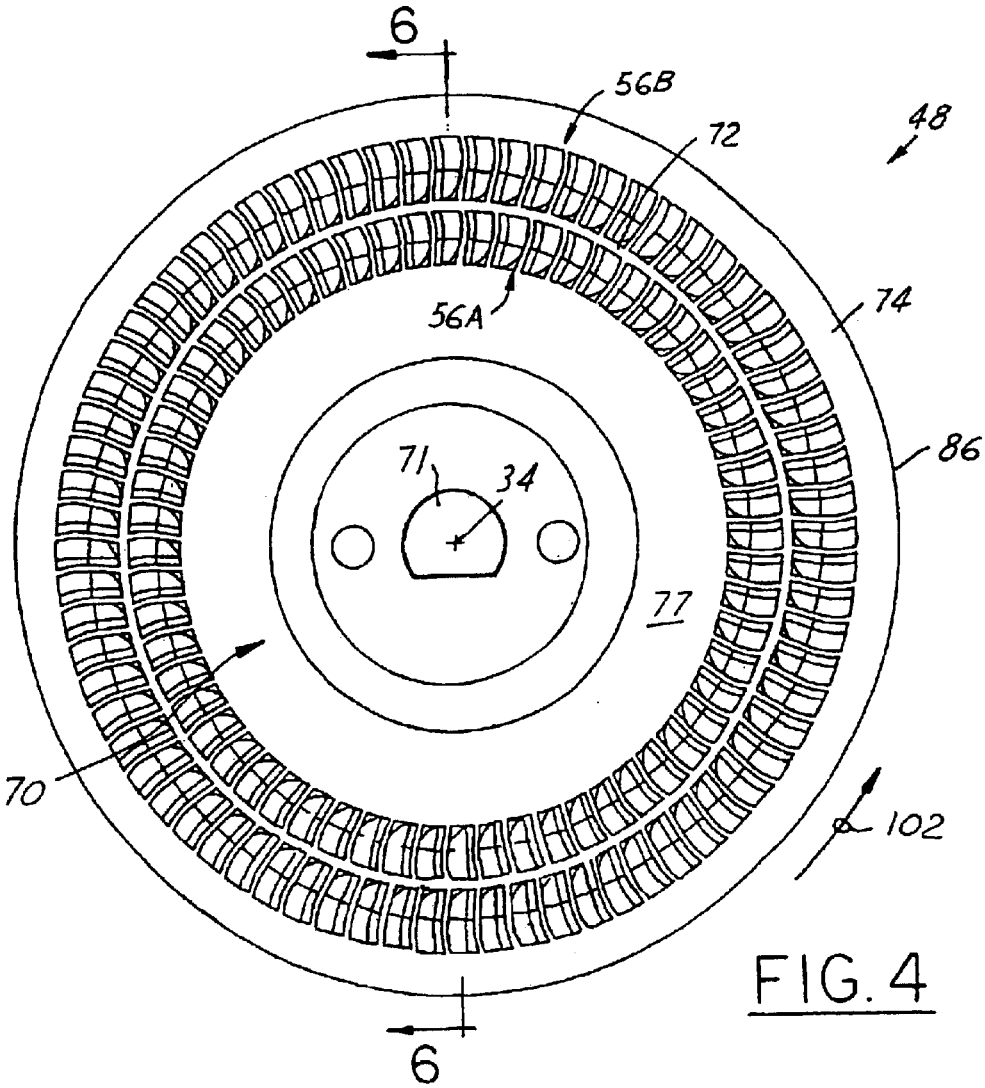
FIG. 4 is a top plan view of the impeller shown in FIG. 3.

Turning now to FIGS. 3–4, impeller 48 of the present invention rotates about the rotational axis 34 in a direction designated by arrow 102. Impeller 48 is a generally disc-shaped component having a top face 77 directly facing the bottom surface 59 of the upper casing, and a bottom face 79 directly facing the top surface 69 of the lower casing. To prevent or minimize fuel cross-flow between the inner and outer pumping chambers 54A, 54B and to prevent fuel leakage in general, the top face 77 is in a fluid sealing relationship with the bottom surface 59, and the bottom face 79 is in a fluid sealing relationship with the top surface 69. A circular hub 70 of the impeller 48 carries a key hole 71, through which the rotating shaft 35 extends such that the shaft and impeller co-rotate about axis 34. The hub 70 extends radially outward to the inner vane array 56A. A mid-hoop 72 is disposed radially between the inner and outer vane arrays 56A, 56B, and an outer hoop 74 is disposed radially outward from the outer vane array 56B.

The hub 70 is defined on a radially outward circumferential perimeter by an outwardly facing surface 66A, which was previously discussed in connection with FIG. 2. It is from this surface, which is henceforth referred to as the outer hub surface 66A, that the plurality of vanes 78A extend in a generally radial outward fashion.

Figure 5:
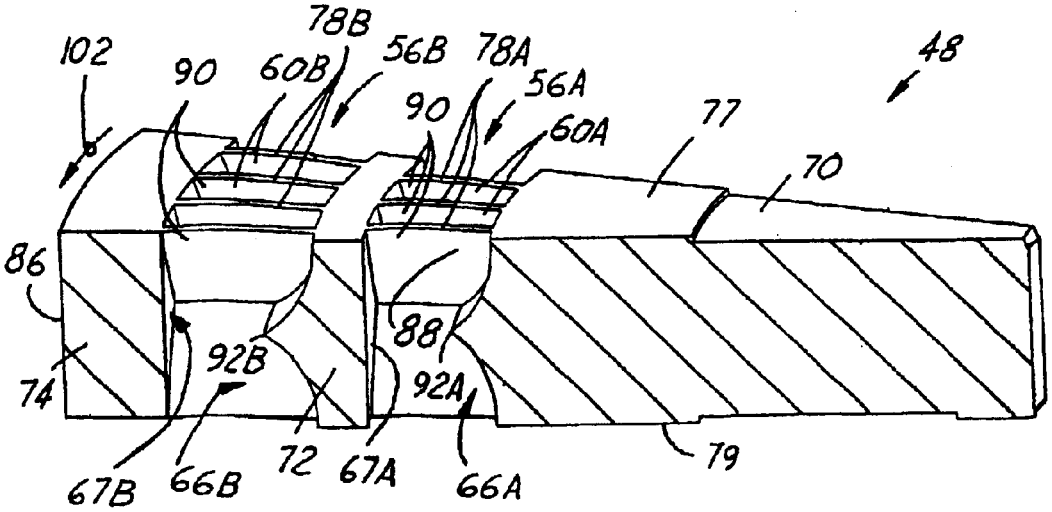
FIG. 5 is a perspective fragmentary view of the impeller shown in FIG. 3.
Figure 6:
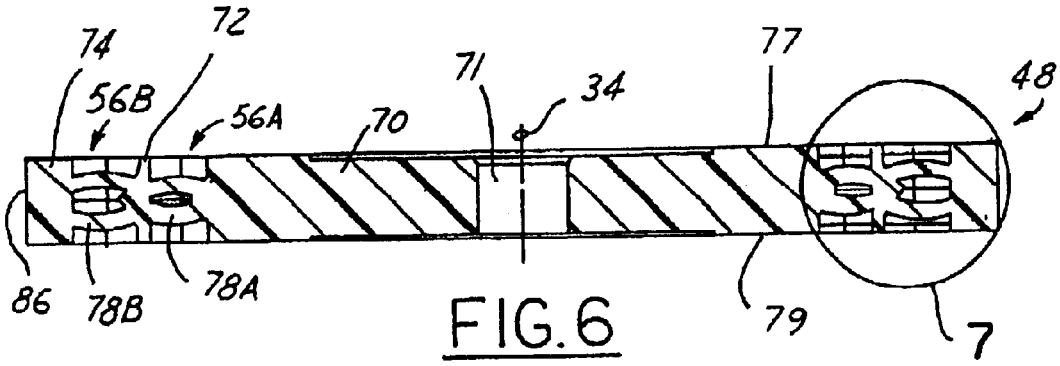
FIG. 6 is a cross-sectional view of the impeller shown in FIG. 4 taken along lines 6—6.
Figure 7:
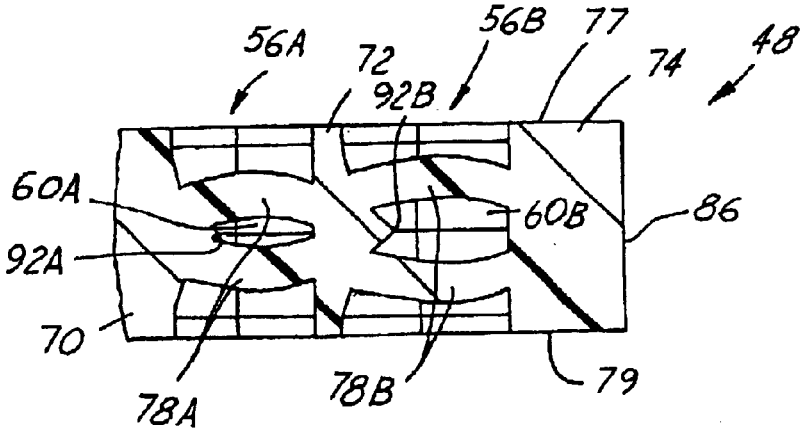
FIG. 7 is a partial enlarged view of the inner and outer vane arrays of the impeller shown in FIG. 6.

With reference now to FIGS. 5–7, the inner vane array 56A includes numerous individual vanes 78A, each of which projects radially outward from outer hub surface 66A to the inward facing surface 67A, which was also discussed in conjunction with FIG. 2. For purposes of clarity, surface 67A will henceforth be referred to as the inner mid hoop surface 67A. The mid hoop 72 is defined radially between and carries inner mid hoop surface 67A, as well as an outward facing surface 66B, now referred to as outer mid hoop surface 66B. Each vane 78B of the outer vane array 56B projects radially outward from outer mid hoop surface 66B to the inward facing surface 67B. The outer hoop 74 is located on the outer periphery of the impeller and is defined radially between inner surface 67B and a peripheral edge 86 of the impeller. For clarification, surfaces 66A, 67A, 66B and 67B, as shown in FIG. 5, are the same as those shown in FIG. 2 that were previously discussed. The peripheral edge 86 directly opposes a downward projecting annular shoulder 87 of the upper casing 42, as best seen in FIG. 1. A distal annular surface of the shoulder 87 sealably engages the top surface 69 of the lower casing 44.

Each vane 78A of the inner vane array 56A and each vane 78B of the outer vane array 56B radially extends within the impeller 48 in a non-linear fashion, such that it increases the pumping efficiency of the impeller. The vanes will now be described in connection with several Figures, each of which shows the vanes from a different perspective and highlights different attributes of the vanes and/or the impeller.

Figure 8:
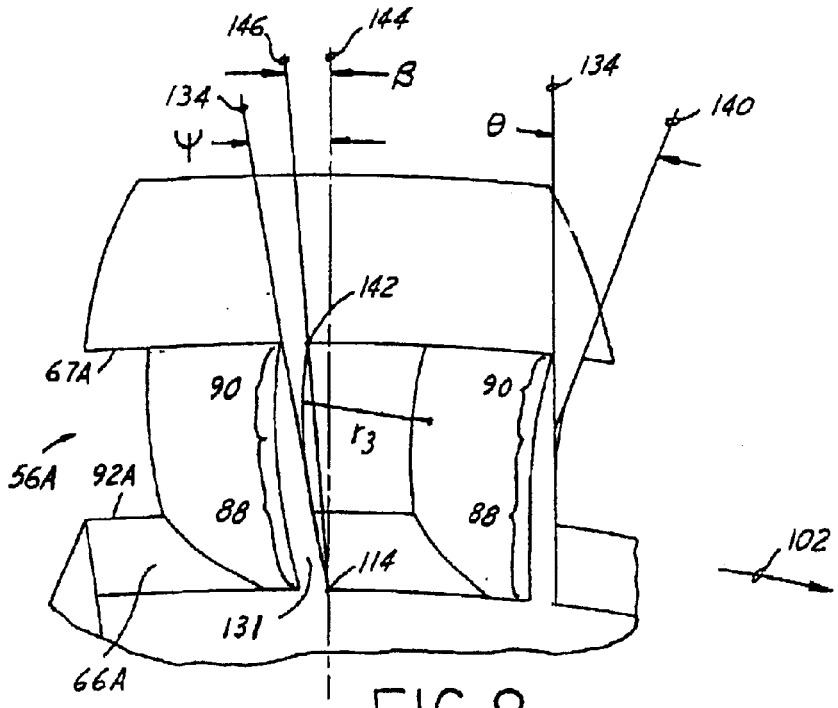
FIG. 8 is an enlarged, partial, bottom plan view of the impeller shown in FIG. 4.

Turning now to FIG. 8, there is shown an enlarged view of the inner vane array 56A, however, the following description applies equivalently to the outer vane array 56B, unless otherwise stated. Each vane includes a root segment 88 that linearly projects in a substantially radial direction, as indicated by line 134, outwardly from outer hub surface 66A. The line 134, and hence linear root segment 88, extends in a slightly retarded or trailing direction, with respect to the impeller's radius 144 when considered in the direction of rotation 102. In this figure, line 134 lies along the leading face of the vane and thus passes through a point 114, however, this line could just as easily be drawn along the trailing side of the vane or through the middle of the vane, as long as it is parallel to the vane faces. Similarly, the impeller radius 144 is also drawn such that it passes through point 114. This trailing orientation of the linear root segment 88 forms an angle $\psi$, which is defined as the angle between line 134 and the radius 144 of the impeller; the radius of the impeller, of course, passes through the center of the impeller. The angle $\psi$ is in the range of 2°–20°, desirably in the range of 5°–15°, and is preferably about 10°. A tip segment 90 of each vane projects contiguously from the outer terminus or outermost radial portion of the root segment 88 to the inner mid hoop surface 67A. As shown in the drawings, tip segment 90 is slightly curved such that it is concave with respect to the direction of rotation 102. That is, tip segment 90 is curved such that the linear root segment and the curved tip segment form a fuel catching pocket when impeller 48 is rotating in direction 102. Preferably, tip 90 has a uniform curve that is defined by an imaginary radius $r_3$ that has a length in the range of between 1.00 mm–5.00 mm, and more preferably in the range of 2.25 mm–3.25 mm for the inner vane array 56A and 2.75 mm–3.75 mm for the outer vane array 56B. As the tip segment 90 projects substantially radially outward from the distal end of the root segment 88 (the distal end of the root segment being the most retarded or trailing radial position on the vane), it also projects in a slightly advanced direction with respect to the linear root segment, when considered in the direction of impeller rotation 102. This advanced alignment is shown in FIG. 8 as angle $\theta$, which represents the angular separation between the retarded line 134, which extends along the leading face of linear root segment 88, and the advanced line 140, which is tangential to a point on the leading face of the curved tip segment 90. Because the orientation of the line 140 is dependent upon the particular point along the leading face of the tip segment with which it is tangential, the angle $\theta$ varies along the radial extent of the tip segment 90. Angle $\theta$ is in the range of 0°–50°, desirably 15°–35°, and preferably about 28° assuming line 140 is tangential to a point located at the radially outermost end of the tip segment (a point proximate to where the tip segment 90 joins surface 67A). The advanced tip angle $\theta$ increases the pumping efficiency as a result of the fuel flow leaving the impeller 48 at a forward tangential velocity that is greater than the tangential speed of the impeller. Although not designated by a particular angle in the drawings, the advanced line 140 extends in a direction that is also advanced of the impeller radius 144, when considered in the rotational direction 102. As with angle $\theta$, this angle varies over the radial extent of the tip segment 90, depending upon the particular point along the leading surface of the curved tip segment from which the tangential line originates. For example, a line tangent to the radially innermost point on the tip segment 90 is oriented at a different angle than a line tangent to the radially outermost point (point 142) on the tip segment. The range of angles between tangential line 140 and the impeller radius 144 is within the range of 0°–30°, is desirably between 10°–25°, and is preferably about 18° assuming line 140 is tangential to a point located at the radially outermost end of the tip segment. Furthermore, the root and tip segments preferably have equal radial lengths; stated differently, the radial distance from surface 66A to the end of the root segment 88 is approximately equal to the radial distance from the beginning of the tip segment 90 to surface 67A, in a preferred embodiment.

The advance in circumferential travel of the tip segment 90 is generally not as great as the retard in circumferential travel of the root segment 88. Therefore, the overall radial projection of the vanes between the outer hub surface 66A and the inner mid hoop surface 67A, is slightly retarded when considered in the direction of impeller rotation 102. In other words, the radially innermost point 114 on the leading surface of the vane is advanced when compared to the radially outermost point 142 on the leading surface the vane, when considered in the direction of rotation 102. This retarded or trailing alignment is demonstrated as angle $\beta$, which represents the angular separation between the impeller radius 144 and straight line 146, which connects points 114 and 142. It follows, that during rotation of the impeller, point 114 reaches a particular angular position before point 142. Angle $\beta$ is in the range of 0°–10°, is desirably between 0°–5°, and is preferably about 2°.

Figure 9:
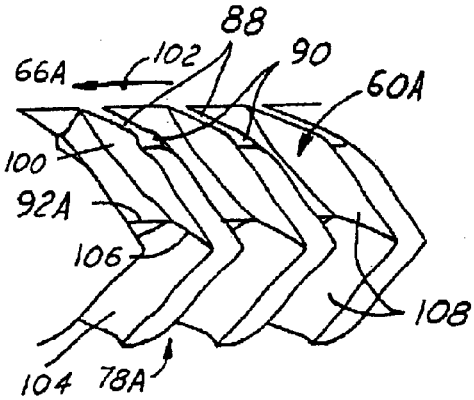
FIG. 9 is a partial perspective view of the impeller shown in FIG. 3 looking radially inward with portions removed to show internal detail of a leading surface of the vanes.
Figure 10:
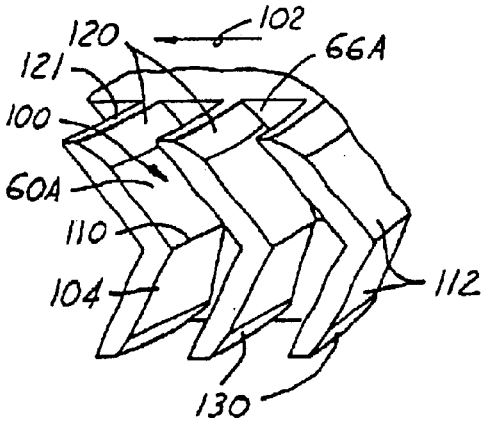
FIG. 10 is a partial perspective view of the impeller shown in FIG. 3 looking radially inward with portions removed to show internal detail of a trailing surface of the vanes.
Figure 11:
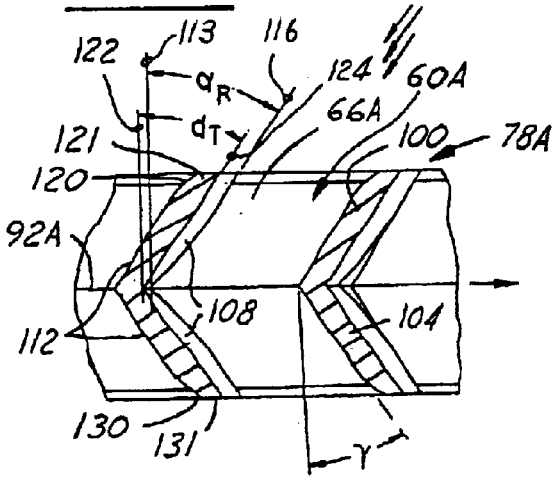
FIG. 11 is a partial cross sectional view of the impeller shown in FIG. 3 looking radially inward.
Figure 21:
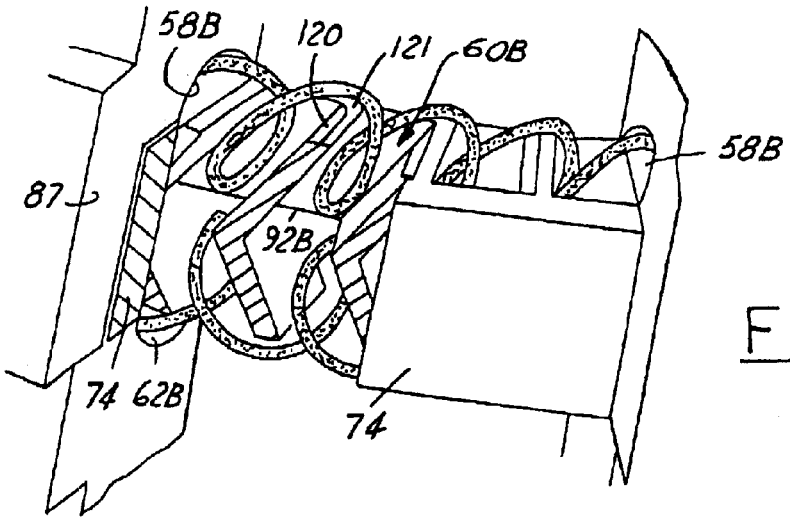
FIG. 21 is a partial perspective view of the pumping chambers and impeller with portions removed to illustrate the helical flow path of the fuel.

For the purposes of clarity and simplicity, the following paragraphs will only describe vanes of the inner vane array with the understanding that the vanes of the outer vane array are substantially identical unless otherwise stated. Referring now to FIGS. 9–11, but paying particular attention to FIG. 11, the imaginary plane wherein the ridge 92A lies, bisects the V-shaped vane 78A into an upper half 100 and a lower half 104 along a leading intersection line 106 on a leading surface 108 of the vane, and along a trailing intersection line 110 on a trailing surface 112 of the vane. The concave leading surface 108 of one vane faces the convex trailing surface 112 of an adjacent vane 78A. The upper half 100 and the lower half 104 of the vanes 78A are sloped or inclined forward in the direction of impeller rotation 102; that is, they generally extend from the imaginary plane carrying the ridge 92A, to the respective imaginary planes carrying the top and bottom faces 77, 79 of the impeller in the direction of rotation. The incline angle of the upper half 100 is a substantial mirror image of the incline angle of the lower half 104; that is, they are preferably symmetrical. That incline angle should be greater than 0° to increase pumping efficiency and low voltage flow. The forward incline of the vane allows for better entry of the fuel into the vane pocket 60A, thus producing the helical trajectory of fuel flow, as best shown in FIG. 21. In other words, the fuel rises in pressure as it flows within the pumping chambers 54A, 54B by the mechanical rotation of the impeller 48 and the vortex-like, helical flow characteristics of the fuel. The fuel flow pattern is induced by the respective circumferential vane arrays 56A and 56B which causes the fuel to flow repeatedly into and out of the grooves 58A, 58B and 62A, 62B.

During manufacturing of the impeller 48, the impeller must be released from the mold via a rotational motion. Therefore, the root segment 88 of the vane has an incline angle $\alpha(R)$ which is equal to, or preferably slightly less than, an incline angle $\alpha(T)$ of the tip segment 90. The incline angles $\alpha(R)$ and $\alpha(T)$ can be measured from either the leading or the trailing sides of the vane, as they are preferably parallel. Preferably, the incline angle $\alpha$ of the inner vane array gradually increases from the root segment 88 through the tip segment 90, and is in the range of 10°–50°, is desirably in the range of 20°–40°, and is preferably about 25° at the radially innermost point of the root segment and is preferably 35° at the radially outermost point of the tip segment. An equivalent relationship exists for the vanes of the outer array, however, their incline angle is in the range of 15°–55°, is desirably between 20°–45°, and is preferably about 30° at the radially innermost point of the root segment and 40° at the radially outermost point of the tip segment. Accordingly, the following relationship between the incline angle at the root versus that angle at the tip holds true for both the inner and outer vane array: $10° \leqq \alpha(R) \leqq \alpha(T) \leqq 55°$. The incline angle $\alpha(R)$ of the root segment is measured in degrees between a reference line 113, which is parallel to the rotating axis 34, and an incline line 116 which lies along a leading surface of vane 78A at the root segment 88. As previously stated, each of the vane upper and lower halves 100, 104 have leading and trailing surfaces 108, 112 that are parallel; that is, the vane has a uniform vane thickness in the circumferential direction. Thus, incline line 116 could alternatively be located along the trialing vane surface as well. Reference line 113 and incline line 116 preferably intersect each other at a point that lies on the leading face of the vane. Separately, the radially innermost ends of the leading intersection line 106 and the trailing intersection line 110 are contiguous to the ridge 92A, as best shown in FIGS. 9 and 10.

The incline angle $\alpha(T)$ of the tip is measured in degrees between reference line 122, which is parallel to both the rotating axis 34 and the reference line 113, and an incline line 124, which preferably lies along the leading surface 108 of the vane in the region of the tip segment 90. As previously explained, incline line 124 could lie along the trailing vane surface 112 as well.

Also, the incline angles $\alpha(R)$ and $\alpha(T)$ of the vanes of the inner vane array 56A are respectively less than those of the vanes of the outer vane array 56B. Amongst other benefits, this difference in angles allows the impeller to be rotated out of a single rotational mold during manufacturing. This incline angle arrangement does not sacrifice pump performance, since the vanes of the inner vane array 56A operate with a higher pressure coefficient and thus require a smaller incline angle $\alpha$ for optimum performance than do the vanes of the outer vane array 56B.

As previously discussed, the root segment 88 radially extends outward from the outer hub surface 66A in a retarded or trailing manner, with respect to the radius of the impeller 144. It follows, that the leading intersection line 106, which separates the upper and lower halves 100, 104 of the vane, includes a radially inward portion that also extends in a retarded or trailing manner, with respect to radius 144 when considered in direction 102. This radially inward portion of the leading intersection line 106 is the portion that linearly extends from the ridge 92A to the radially outer terminus of the root segment. Leading intersection line 106 also includes a radially outward portion that extends in an advanced, curvilinear direction, just like the tip segment 90. This radially outward portion is the portion of the leading intersection line 106 that begins where the radially inward portion left off, and extends outward to the inner mid hoop surface 67A. Stated differently, the leading intersection line 106 includes a radially inward portion that is part of the root segment 88 and thus extends in a retarded, linear direction, and a radially outward portion that is part of the tip segment 90 and thus extends in an advanced, curved direction. As previously indicated this pocket forming or cupped vane configuration, when considered in both the radial and the axial directions, enhances pumping efficiency.

As shown in FIG. 11 and as previously mentioned, each half 100, 104 of each vane 78A also has a back angle $\gamma$ which is preferably equal to the opposite front incline angles $\alpha(R)$ and $\alpha(T)$. This results in a uniform vane thickness when considered in a circumferential direction, and eases the manufacturing process by allowing for the release of the impeller following the molding process. It is possible, however, for the back angle $\gamma$ to be greater than the corresponding front incline angle ("corresponding" means the portion of the front surface 108 that is at the same radial position on the vane), which would result in vanes having front and rear surfaces that converge together as they approach the axial side walls or ends of the vane. Consequently, because the minimum value of $\alpha(R)$ is 10° and because $\alpha(T)$ is equal to or greater than $\alpha(R)$, then the minimum value of $\gamma$, along the entire radial extent of the vane, is also 10°.

Each vane also includes two radii 120, 130 formed along edges located between the trailing vane surface 112 and adjacent upper and lower side walls 121, 131. Sidewall 131, best seen in FIG. 8, is the fingerlike surface of the vane which generally lies in the same plane as the bottom face of the impeller, and opposes the top surface 69 of the lower casing. Similarly, sidewall 121, which is not shown in FIG. 8, is the complimentary fingerlike surface of the vane that is located on the opposite axial side of the impeller, and thus, generally lies in the same plane as the top face 77 of the impeller such that it opposes the bottom surface 59 of the upper casing. Radius 120 is a uniform rounded surface that extends the entire radial length of the vane, and therefore includes a portion that is part of the root segment 88 and a portion that is part of the tip segment 90. Constructing the radius such that it is a rounded surface with a particular radius (0.70 mm in the preferred embodiment) helps align the trailing surface of the vane with the incoming fuel stream, thereby increasing the efficiency of the pump by reducing cavitation and the creation of unwanted vapors. Both the back angle γ and the radius 120 are selected such that they are aligned as best as possible with an incoming fuel stream (shown as arrows in FIG. 11) as it enters the vane pocket 60A. Experimentation has shown that the use of a rounded radius on the impeller of the present invention is preferable over the use of a flat chamfer, as is sometimes used in the art.

Of course, the previous explanation of impeller components, particularly the linear root segment, curved tip segment, circumferential ridge, vane pockets, upper vane half, lower vane half, leading intersection line, trailing intersection line, and radius, as well as all angles, reference lines, imaginary planes, etc. pertaining thereto, apply equally to the outer vane array 56B, unless stated otherwise. Moreover, the previous discussion is not specifically limited to a dual vane array impeller, as it could equally apply to other multi vane array impellers having three, four, or any other number of vane arrays that may practicably be utilized by the impeller.

Figure 15:
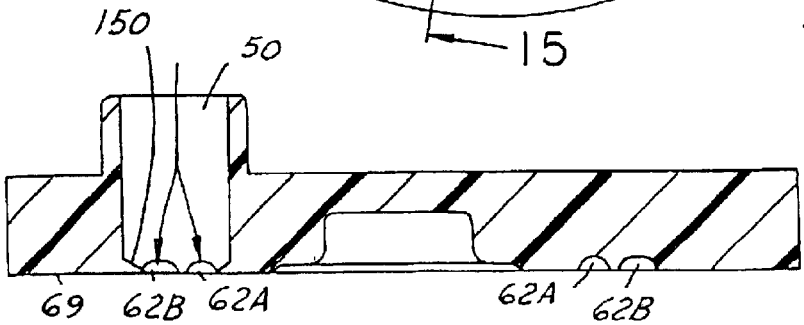
FIG. 15 is an enlarged cross-sectional view of the lower casing of the turbine fuel pump assembly shown in FIG. 1.
Figure 16:
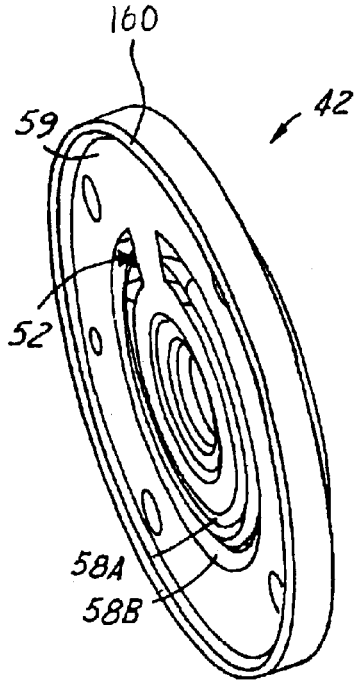
FIG. 16 is a perspective view of the upper casing of the turbine fuel pump assembly shown in FIG. 1.
Figure 17:
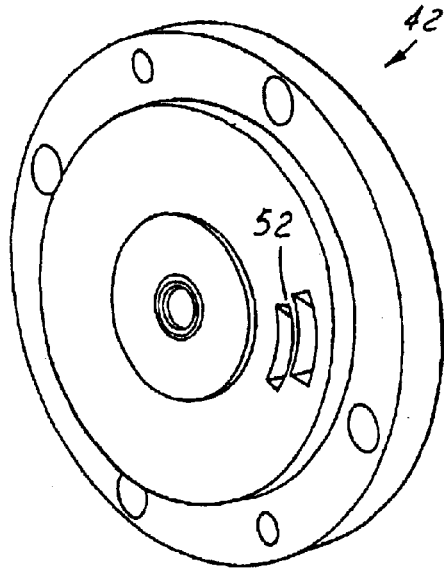
FIG. 17 is a second perspective view of the upper casing of the turbine fuel pump assembly shown in FIG. 1.
Figure 18:
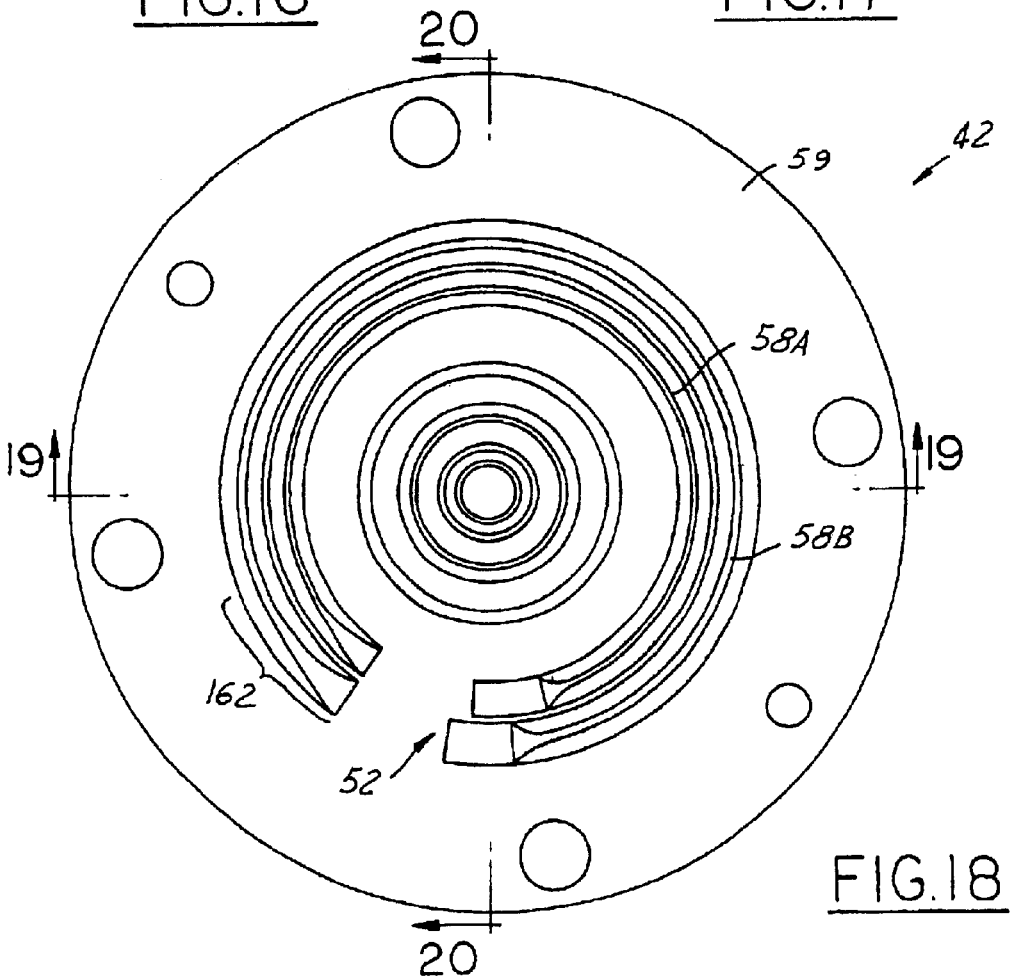
FIG. 18 is a bottom plan view of the upper casing of the turbine fuel pump assembly shown in FIG. 1.
Figure 19:
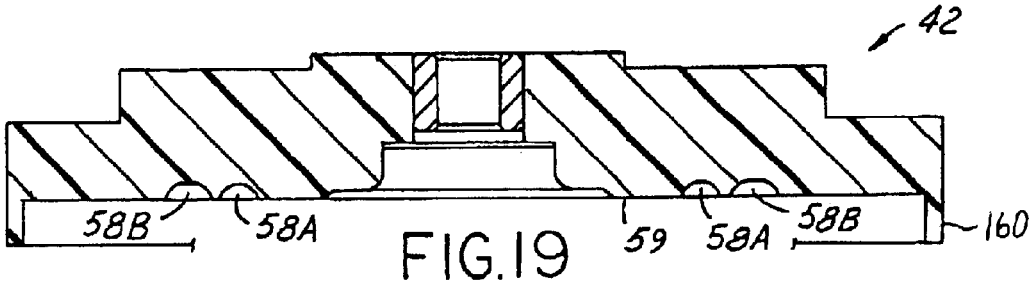
FIG. 19 is an enlarged cross-sectional view of the upper casing of the turbine fuel pump assembly shown in FIG. 18 taken along lines 19—19.
Figure 20:
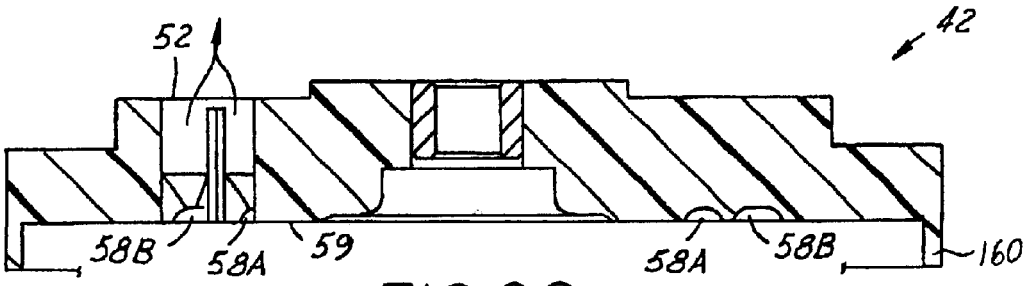
FIG. 20 is an enlarged cross-sectional view of the upper casing of the turbine fuel pump assembly shown in FIG. 18 taken along lines 20—20.

Turning now to FIGS. 12–15, the lower casing 44 of the turbine fuel pump assembly is shown in greater detail and, as previously discussed, is a disk-shaped component that generally includes an inlet passage 50 and a top surface 69 having inner and outer grooves 62A, 62B formed thereon. Inlet passage 50 is in fluid communication with both the contents of a fluid reservoir, such as a vehicle fuel tank, and the lower grooves 62A and 62B. As indicated in FIG. 15 by the branching arrows, fuel is brought into the turbine fuel pump assembly 30 via the inlet passage 50 such that a portion of the incoming fuel is diverted to the lower inner groove 62A and a separate portion is diverted to the lower outer groove 62B. The allocation of diverted fuel to each of the lower grooves is dependent upon the particular design of the inlet passage, the junction between the inlet and the grooves, the shape and size of the grooves, as well as other design factors. As previously mentioned, the outer pumping chamber 54B, and hence the lower outer groove 62B, has a larger cross-sectional size than that of the corresponding inner pumping chamber and lower inner groove, respectively. Accordingly, the outer groove can accommodate a greater volume of fuel and thus the portion of fuel diverted to the lower outer groove 62B is greater than that portion diverted to the lower inner groove 62A. Again, numerous other characteristics play a part in determining the portions of incoming fuel that are diverted to each of the lower grooves. One of those characteristics is the tapered or reduced diameter section 150; this section tapers right to the edge of each of the lower grooves such that all of the incoming fuel is guided to either the inner or outer lower groove. Though this section of the inlet passage 50 has a reduced diameter when compared with the remainder of the passage, it is still large enough to encompass both the inner and outer lower grooves 62A, 62B, as shown in FIG. 15. The non-semi-circular cross-sectional shape of the grooves has already been discussed in connection with FIG. 2, and thus will not be repeated here.

Figure 12:
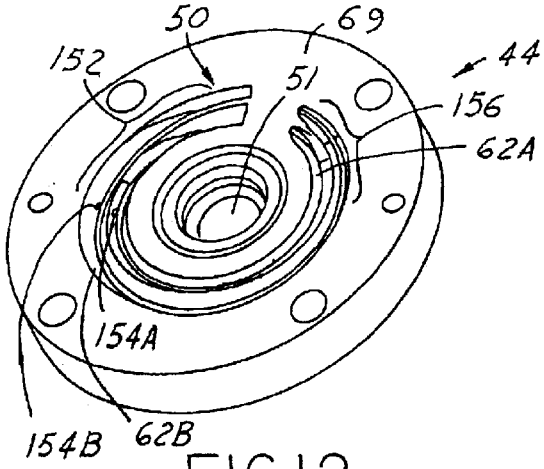
FIG. 12 is a perspective view of the lower casing of the turbine fuel pump assembly shown in FIG. 1.
Figure 13:
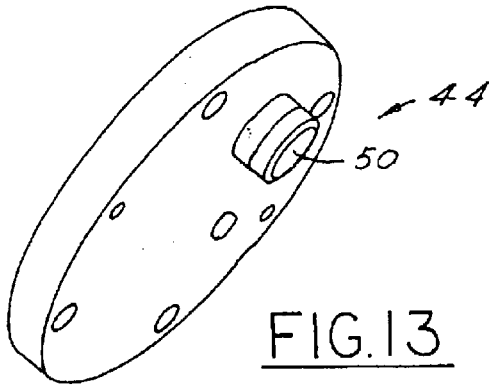
FIG. 13 is a second perspective view of the lower casing of the turbine fuel pump assembly shown in FIG. 1.
Figure 14:
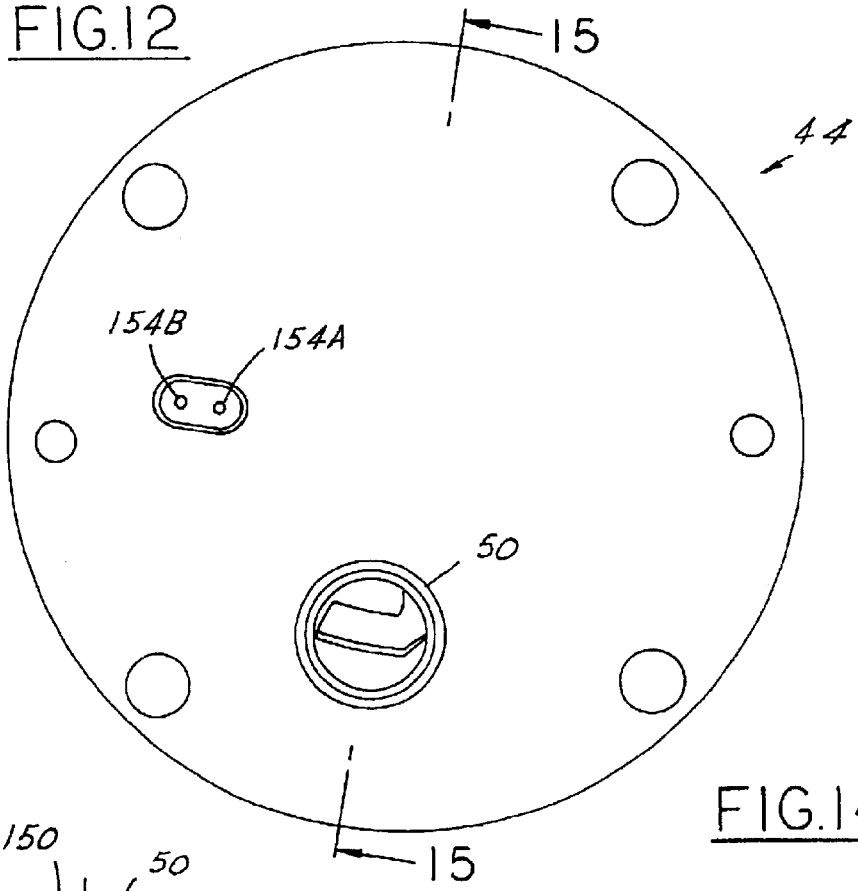
FIG. 14 is a bottom plan view of the lower casing of the turbine fuel pump assembly shown in FIG. 1.

With reference to FIG. 12, the lower inner and outer grooves 62A, 62B each includes a first section 152 which extends for approximately the first 30°, beginning from the inlet passage 50. First section 152 is an axially tapered section of the groove where the depth of the groove is gradually reduced as it circumferentially extends around the casing. This reduction in groove depth causes a corresponding reduction in the cross-sectional area of the groove, which in turn causes vapors in the fuel to be forced out of the liquid as the fuel flows through the first section, as is known in the art. Two vent holes 154A, 154B are located at the end of the first section 152, and provide the fuel vapors with a conduit for escaping. A similar axially tapered section, second section 156, is located towards the end of the annular extent of the lower grooves 62A, 62B; that is, second section 156 extends for approximately 30° and ends in a segment of the lower grooves that corresponds to outlet passage 52. Referring now to FIGS. 16–20, the upper casing 42 will be described in more detail.

The upper casing 42 is quite similar to the lower casing just described, and generally includes a lower surface 59 having upper inner and outer grooves 58A, 58B formed thereon, an outlet passage 52, and a circumferentially extending lip or flange 160. The upper inner and outer grooves 58A, 58B each includes an axially tapered section, third section 162, but does not include two axially tapered sections as with the lower grooves. Third section 162 is tapered in an opposite or complimentary manner to that of first section 152; that is, while first section 152 of the lower grooves is decreasing in cross-sectional area, third section 162 of the upper grooves is increasing in cross-sectional area over the same angular extent. Complimentarily shaped tapers such as these promote adequate fuel distribution into both the upper and lower grooves, as opposed to a disproportionate amount remaining in the lower grooves because they are in direct communication with the inlet passage 50. Lip 160 circumferentially extends around the outer periphery of the upper casing 42 and provides a surface for the lower casing 44 to rest upon. By resting upon the lip 160, as opposed to surface 59 itself, the lower casing 44 and upper casing 42 create impeller cavity 46 which is located there between. The height and other attributes of the lip can vary, as they are dependent upon the thickness of the impeller 48 as well as other design considerations.

In operation, rotation of impeller 48 causes fuel to flow into the pumping section 32 via the fuel inlet passage 50, which directly communicates with independent, lower inner and outer grooves 62A, 62B. During its propulsion through the first section 152, fuel is forced into the upper inner and outer grooves 58A, 58B, such that an appropriate distribution of fuel is achieved between the upper and lower grooves. This produces a somewhat uniform fuel distribution between the upper and lower parts of the inner and outer pumping chambers 54A and 54B, such that approximately equal forces reside on both axial sides of the impeller. As best seen in FIG. 21, the fuel rises in pressure as it is propelled by the rotating impeller 48 in what is a vortex-like flow pattern within the independent pumping chambers 54A, 54B. The vortex-like flow pattern is induced by the inner and outer circumferential vane arrays 56A, 56B, which act upon the fuel independently from one-another. More specifically, each of the grooves 62A, 62B interacts with its corresponding curved sections 75A, 75B of the vane arrays to produce their own generally independent helical flow pattern of fuel. This flow pattern spirals in and out of the vane pockets and adjacent grooves such that the vane pockets and grooves are in fluid communication in the lateral or axial direction. In the preferred embodiment, this results in a total of four helical fuel flow patterns (two in the inner pumping chamber 54A and two in the outer pumping chamber 54B), however, some cross communication between fuel flow patterns may occur. For instance, upper grooves 58A, 58B may still communicate with the lower grooves 62A, 62B via the open vane pockets which are defined between adjacent vanes; stated differently, because the circumferentially extending ridges 92A, 92B do not extend the entire radial extent of the vane pockets, they are open and allow for the possibility of fuel communicating between the lower and upper grooves. This open pocket configuration permits fuel flowing from the inlet passage 50 to flow through the lower grooves into the respective upper grooves and likewise, it permits fuel to the exit by flowing from the lower grooves through the respective upper grooves and into the outlet passage 52. Once the fuel reaches the annular end of the pumping chambers, the now pressurized fuel exits pumping section 32 through the fuel outlet passage 52. If mounted in a vehicle, outlet passage 52 would then provide the pressurized fuel to some type of conduit or other component of a vehicle fuel delivery system, from which, the fuel would be supplied under pressure to an internal combustion engine.

Figure 22:
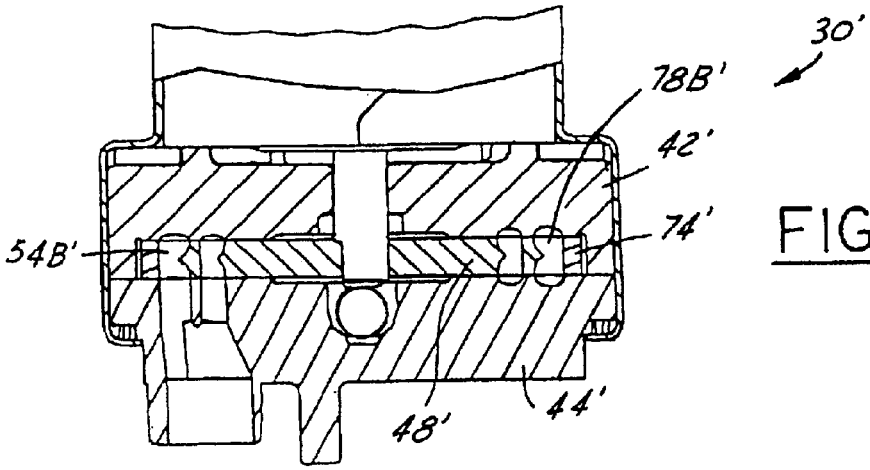
FIG. 22 is a partial cross-sectional view of a second embodiment turbine fuel pump assembly of the present invention.

According to the alternative embodiment shown in FIG. 22, a turbine fuel pump assembly 30' is illustrated where the outer hoop of the impeller of the previous embodiment has been removed and replaced with a stationary guide ring 74', as is known in the art. The stationary guide ring 74' is not an integral portion of the impeller and accordingly does not rotate with the impeller. Stationary guide ring 74' includes a stripper portion (not shown) that shears the fuel off of the open ends or tips of the vanes of an outer circumferential vane array. In other words, an outer annular pumping chamber 54B' is disposed along the outer most periphery of the impeller so that the outer most vane pockets 78B' communicate in both the axial direction and in the radial direction. This type of arrangement is known in the art, and is sometimes referred to as Peripheral Vane Technology (PVT).

It will thus be apparent that there has been provided in accordance with the present invention a turbine fluid pump assembly which achieves the aims and advantages specified herein. It will, of course, be understood that the foregoing description is of preferred exemplary embodiments of the invention and that the invention is not limited to the specific embodiments shown. Various changes and modifications will become apparent to those skilled in the art and all such changes and modifications are intended to be within the scope and spirit of the present invention as defined in the following claims.

What is claimed is:

1. A single-stage turbine fluid pump assembly, comprising:

a lower casing having a fluid inlet passage and a top surface that includes first and second lower annular grooves that are each in fluid communication with said inlet passage but are generally independent of each other;

an upper casing having a fluid outlet passage to the exterior of the upper casing and a bottom surface that includes first and second upper annular grooves that are each in fluid communication with said fluid outlet passage but are generally independent of each other;

between said fluid inlet passage and said fluid outlet passage all the first annular grooves are independent of all of the second annular grooves and none of the first annular grooves are connected with any of the second annular grooves, an impeller cavity formed between said top and bottom surfaces, said cavity being in fluid communication with said fluid inlet passage via said first and second lower annular grooves and being in fluid communication with said fluid outlet passage via said first and second upper annular grooves;

an electric motor having a rotating shaft; and an impeller operably coupled to said shaft such that rotation of said shaft causes said impeller to rotate within said impeller cavity, said impeller having a first vane array that operably communicates with said first lower and upper annular grooves and a second vane array that operably communicates with said second lower and upper annular grooves, wherein rotation of said impeller causes a portion of the incoming fluid through said fluid inlet passage to enter said first lower annular groove and a portion to enter said second lower annular groove, and the fluid from all of the annular grooves to be discharged through said fluid outlet passage.

2. The single-stage turbine fluid pump assembly of claim 1, wherein said first and second vane arrays communicate with said first upper and lower annular grooves and said second upper and lower annular grooves, respectively, in an axial direction, but not in a radial direction.

3. The single-stage turbine fluid pump assembly of claim 1, wherein said pump assembly includes a first annular pumping chamber comprised of said first upper annular groove, a first vane pocket, and said first lower annular groove, said pump assembly also includes a second annular pumping chamber comprised of said second upper annular groove, a second vane pocket, and said second lower annular groove.

4. The single-stage turbine fluid pump assembly of claim 3, wherein said second annular pumping chamber has a greater cross-sectional area than that of said first annular pumping chamber.

5. The fluid pump assembly of claim 3, wherein said first and second annular pumping chambers have a cross-section that is generally the same shape.

6. The fluid pump assembly of claim 3, wherein said first and second vane pockets are each an open-pocket configuration.

7. The single-stage turbine fluid pump assembly of claim 1, wherein at least one of said annular grooves has a cross-sectional shape that includes first and second radial sections that are semi-circular and are connected together via a flat section.

8. The single-stage turbine fluid pump assembly of claim 1, wherein at least one of said first upper and lower annular grooves or said second upper and lower annular grooves are symmetric.

9. The single-stage turbine fluid pump assembly of claim 1, wherein said first and second vane arrays each includes a plurality of vanes, wherein one or more of said plurality of vanes comprises an upper half and a lower half generally arranged in a V-shape configuration that opens in the rotational direction of said impeller.

10. The single-stage turbine fluid pump assembly of claim 9, wherein said V-shape configuration of each of said halves is measured by an incline angle $\alpha$, with respect to an axially extending reference line, and wherein said incline angle at said root segment $\alpha(R)$ is<said incline angle at said tip segment $\alpha(T)$.

11. The single-stage turbine fluid pump assembly of claim 10, wherein said incline angle at any point along said root segment $\alpha(R)$ is in the range of 10°–50°.

12. The single-stage turbine fluid pump assembly of claim 11, wherein said incline angle at a radially innermost point of said root segment $\alpha(R)$ is in the range of 20°–30°.

13. The single-stage turbine fluid pump assembly of claim 10, wherein said incline angle at any point of said tip segment $\alpha(T)$ is in the range of 10°–50°.

14. The single-stage turbine fluid pump assembly of claim 13, wherein said incline angle at a radially outermost point of said tip segment $\alpha(T)$ is in the range of 30°–40°.

15. The single-stage turbine fluid pump assembly of claim 9, wherein said upper and lower halves are symmetrical about an imaginary plane that is normal to the impeller axis of rotation and that bisects each of said vanes in half.

16. The single-stage turbine fluid pump assembly of claim 1, wherein said first and second vane arrays each includes a plurality of vanes that each have a uniform vane thickness between leading and trailing vane surfaces, when considered in the circumferential direction.

17. The single-stage turbine fluid pump assembly of claim 1, wherein said first and second vane arrays each includes a plurality of vanes, wherein one or more of said plurality of vanes comprises a sidewall surface, a trailing vane surface and a rounded radius located therebetween.

18. The single-stage turbine fluid pump assembly of claim 17, wherein said rounded radius is uniform along its radial extent, and radially extends from said outer hub surface to said inner hoop surface.

19. The single-stage turbine fluid pump assembly of claim 17, wherein said rounded surface is at least partially defined by a radius in the range of 0.10 mm–1.50 mm.

20. The single-stage turbine fluid pump assembly of claim 19, wherein said radius is approximately 0.70 mm.

21. The single-stage turbine fluid pump assembly of claim 1, wherein said fluid pump is a fuel pump for use with a vehicle fuel delivery system.

22. The single-stage turbine fluid pump assembly of claim 1, wherein said impeller further includes an outer hoop that co-rotates with the impeller.

23. The single-stage turbine fluid pump assembly of claim 1, wherein said fluid inlet passage includes a tapered section at the point at which said passage connects to said lower annular grooves.

24. The single-stage turbine fluid pump assembly of claim 1, wherein said fluid inlet passage is designed to divert a first portion of incoming fluid into said first lower annular groove and a second portion of incoming fluid into said second lower annular groove, whereby said second portion is greater than said first portion.

25. The single-stage turbine fluid pump assembly of claim 1, wherein said fluid inlet passage has a great enough radial extent to encompass both of said first and second lower annular grooves.

26. The single-stage turbine fluid pump assembly of claim 1, wherein at least one of said first and second lower annular grooves includes an axially tapered first section that begins in the area proximate said fluid inlet passage.

27. The single-stage turbine fluid pump assembly of claim 26, wherein said first section extends for a circumferential extent of approximately 30°.

28. The single-stage turbine fluid pump assembly of claim 26, wherein one or more vent hole(s) are located proximate the end of said first section.

29. The single-stage turbine fluid pump assembly of claim 26, wherein at least one of said first and second lower annular grooves further includes an axially tapered second section that ends in the area proximate said fluid outlet passage.

30. A single-stage turbine fluid pump assembly, comprising:

a lower casing having a fluid inlet passage and a top surface that includes first and second lower annular grooves that are each in fluid communication with said inlet passage;

an upper casing having a fluid outlet passage and a bottom surface that includes first and second upper annular grooves that are each in fluid communication with said outlet passage;

an impeller cavity formed between said top and bottom surfaces, said cavity being in fluid communication with said fluid inlet passage via said first and second lower annular grooves and being in fluid communication with said fluid outlet passage via said first and second upper annular grooves;

an electric motor having a rotating shaft;

an impeller operably coupled to said shaft such that rotation of said shaft causes said impeller to rotate within said impeller cavity, said impeller having a first vane array that operably communicates with said first lower and upper annular grooves and a second vane array that operably communicates with said second lower and upper annular grooves;

wherein rotation of said impeller causes a portion of the incoming fluid through said fluid inlet passage to enter said first lower annular groove and a portion to enter said second lower annular groove;

wherein said fluid pump assembly further includes a first annular pumping chamber comprised of said first upper annular groove, a first vane pocket, and said first lower annular groove, and a second annular pumping chamber comprised of said second upper annular groove, a second vane pocket, and said second lower annular groove; and;

wherein said first and second vane pockets are each bounded on a radially inward side by a surface that includes a circumferentially extending ridge.

31. The single-stage turbine fluid pump assembly of claim 30, wherein said ridge culminates in a point.

32. The single-stage turbine fluid pump assembly of claim 30, wherein at least one of said circumferentially extending ridges radially extends a partial distance into the corresponding vane pocket, such that generally independent upper and lower helical fluid flow patterns are formed.

33. The single-stage turbine fluid pump assembly of claim 32, wherein some fluid communication exists between said upper and lower helical fluid flow patterns.

34. The single-stage turbine fluid pump assembly of claim 32, wherein said upper helical fluid flow pattern communicates between said vane pocket and one of said upper annular grooves in an axial direction, but not in a radial direction, and wherein said lower helical fluid flow pattern communicates between said vane pocket and one of said lower annular grooves in an axial direction, but not in a radial direction.

35. A single-stage turbine fluid pump assembly, comprising:

a lower casing having a fluid inlet passage and a top surface that includes first and second lower annular grooves that are each in fluid communication with said inlet passage;

an upper casing having a fluid outlet passage and a bottom surface that includes first and second upper annular grooves that are each in fluid communication with said outlet passage;

an impeller cavity formed between said top and bottom surfaces, said cavity being in fluid communication with said fluid inlet passage via said first and second lower annular grooves and being in fluid communication with said fluid outlet passage via said first and second upper annular grooves;

an electric motor having a rotating shaft;

an impeller operably coupled to said shaft such that rotation of said shaft causes said impeller to rotate within said impeller cavity, said impeller having a first vane array that operably communicates with said first lower and upper annular grooves and a second vane array that operably communicates with said second lower and upper annular grooves;

wherein rotation of said impeller causes a portion of the incoming fluid through said fluid inlet passage to enter said first lower annular groove and a portion to enter said second lower annular groove; and;

wherein said first and second vane arrays each includes a plurality of vanes, wherein one or more of said plurality of vanes comprises:

i) a linear root segment extending away from an outer surface in a first direction; and ii) a curved tip segment extending away from an outer terminus of said root segment and towards an inner surface such that a line tangent to said curved tip segment extends in a second direction.

36. The single-stage turbine fluid pump assembly of claim 35, wherein said first direction is retarded with respect to said second direction (angle θ) when considered in the rotational direction of said impeller.

37. The single-stage turbine fluid pump assembly of claim 36, wherein said angle θ is in the range of 0°–50°, assuming said line tangent to said curved tip segment is tangent to a point located anywhere on said curved tip segment leading surface.

38. The single-stage turbine fluid pump assembly of claim 37, wherein said angle θ is in the range of 15°–35°, assuming said line tangent to said curved tip segment is tangent to a point located at a radially outermost point on said curved tip segment.

39. The single-stage turbine fluid pump assembly of claim 35, wherein said first direction is retarded with respect to the radius of the impeller (angle ψ) by a certain number of degrees, when considered in the rotational direction of said impeller.

40. The single-stage turbine fluid pump assembly of claim 39, wherein said angle ψ is in the range of 2°–20°.

41. The single-stage turbine fluid pump assembly of claim 40, wherein said angle ψ is in the range of 5°–15°.

42. The single-stage turbine fluid pump assembly of claim 35, wherein said second direction is advanced with respect to the radius of the impeller by a certain number of degrees, when considered in the rotational direction of said impeller.

43. The single-stage turbine fluid pump assembly of claim 42, wherein said certain number of degrees is in the range of 0°–30°, assuming said line tangent to said curved tip segment is tangent to a point located anywhere on said curved tip segment leading surface.

44. The single-stage turbine fluid pump assembly of claim 43, wherein said certain number of degrees is in the range of 10°–25°, assuming said line tangent to said curved tip segment is tangent to a point located at a radially outermost point on said curved tip segment.

45. The single-stage turbine fluid pump assembly of claim 35, wherein the point at which the leading surface of said tip segment joins said inner surface trails the point at which the leading surface of said root segment joins said outer surface by a certain number of degrees (angle β), when considered in the rotational direction of said impeller.

46. The single-stage turbine fluid pump assembly of claim 45, wherein said angle β is in the range of 0°–10°.

47. The single-stage turbine fluid pump assembly of claim 46, wherein said angle β is in the range of 0°–5°.

48. The single-stage turbine fluid pump assembly of claim 35, wherein said curved tip segment is at least partially defined by a radius having a length in the range of 1.00 mm–5.00 mm.

49. A single-stage turbine fluid pump assembly, comprising:

a lower casing having a fluid inlet passage and a top surface that includes first and second lower annular grooves that are each in fluid communication with said inlet passage;

an upper casing having a fluid outlet passage and a bottom surface that includes first and second upper annular grooves that are each in fluid communication with said outlet passage;

an impeller cavity formed between said top and bottom surfaces, said cavity being in fluid communication with said fluid inlet passage via said first and second lower annular grooves and being in fluid communication with said fluid outlet passage via said first and second upper annular grooves;

an electric motor having a rotating shaft;

an impeller operably coupled to said shaft such that rotation of said shaft causes said impeller to rotate within said impeller cavity, said impeller having a first vane array that operably communicates with said first lower and upper annular grooves and a second vane array that operably communicates with said second lower and upper annular grooves, wherein rotation of said impeller causes a portion of the incoming fluid through said fluid inlet passage to enter said first lower annular groove and a portion to enter said second lower annular groove;

wherein said first and second vane arrays each includes a plurality of vanes, wherein one or more of said plurality of vanes comprises an upper half and a lower half generally arranged in a V-shape configuration that opens in the rotational direction of said impeller; and wherein the vanes of said first vane array have a V-shaped configuration generally defined by a first incline angle α, the vanes of said second vane array have a V-shaped configuration generally defined by a second incline angle α, and wherein said first incline angle is smaller than said second incline angle.

50. A single-stage turbine fluid pump assembly, comprising:

a lower casing having a top surface that includes first and second lower annular grooves;

an upper casing having a bottom surface that includes first and second upper annular grooves;

an impeller cavity formed between said top and bottom surfaces, said cavity being in fluid communication with said first and second lower annular grooves and being in fluid communication with said first and second upper annular grooves;

an electric motor having a rotating shaft;

an impeller operably coupled to said shaft such that rotation of said shaft causes said impeller to rotate within said impeller cavity, said impeller having a first vane array with a plurality of first vane pockets that operably communicate with said first lower and upper annular grooves, and a second vane array with a plurality of second vane pockets that operably communicate with said second lower and upper annular grooves;

a first annular pumping chamber comprising said first lower and upper annular grooves and said first vane pockets, a second annular pumping chamber comprising said second lower and upper annular grooves and said second vane pockets;

a fluid inlet passage in one of said casings and communicating with said first and second pumping chambers adjacent one end thereof;

a fluid outlet passage in and to the exterior of one of said casings and communicating with said first and second pumping chambers adjacent the other end thereof;

between said fluid inlet passage and said fluid outlet passage said first annular pumping chamber is independent of said second annular pumping chamber and not connected with said second annular pumping chamber; and wherein rotation of said impeller causes a portion of the incoming fluid through said fluid inlet passage to enter said first and second pumping chambers, to pass independently through both said first and second pumping chambers, and to be discharged from both of said first and second pumping chambers through said fluid outlet passage at a higher fluid pressure.

51. The single-stage turbine fluid pump assembly of claim 50, wherein said first and second vane arrays communicate with said first upper and lower annular grooves and said second upper and lower annular grooves, respectively, in an axial direction, but not in a radial direction.

52. The single-stage turbine fluid pump assembly of claim 50, wherein said second annular pumping chamber has a greater cross-sectional area than that of said first annular pumping chamber.

53. The single-stage turbine fluid pump assembly of claim 50, wherein at least one of said annular grooves has a cross-sectional shape that includes first and second radial sections that are semi-circular and are connected together via a flat section.

54. The single-stage turbine fluid pump assembly of claim 50, wherein at least one of said first upper and lower annular grooves or said second upper and lower annular grooves are symmetric.

55. The single-stage turbine fluid pump assembly of claim 50, wherein said first and second vane arrays each includes a plurality of vanes, wherein one or more of said plurality of vanes comprises an upper half and a lower half generally arranged in a V-shape configuration that opens in the rotational direction of said impeller.

56. The single-stage turbine fluid pump assembly of claim 55, wherein said V-shape configuration of each of said halves is measured by an incline angle $\alpha$, with respect to an axially extending reference line, and wherein said incline angle at said root segment $\alpha(R)$ is<said incline angle at said tip segment $\alpha(T)$.

57. The single-stage turbine fluid pump assembly of claim 56, wherein said incline angle at any point along said root segment $\alpha(R)$ is in the range of 10°–50°.

58. The single-stage turbine fluid pump assembly of claim 57, wherein said incline angle at a radially innermost point of said root segment $\alpha(R)$ is in the range of 20°–30°.

59. The single-stage turbine fluid pump assembly of claim 57, wherein said incline angle at any point of said tip segment $\alpha(T)$ is in the range of 10°–50°.

60. The single-stage turbine fluid pump assembly of claim 59, wherein said incline angle at a radially outermost point of said tip segment $\alpha(T)$ is in the range of 30°–40°.

61. The single-stage turbine fluid pump assembly of claim 55, wherein said upper and lower halves are symmetrical about an imaginary plane that is normal to the impeller axis of rotation and that bisects each of said vanes in half.

62. The single-stage turbine fluid pump assembly of claim 55, wherein the vanes of said first vane array have a V-shaped configuration generally defined by a first incline angle $\alpha$, the vanes of said second vane array have a V-shaped configuration generally defined by a second incline angle $\alpha$, and wherein said first incline angle is smaller than said second incline angle.

63. The single-stage turbine fluid pump assembly of claim 50, wherein said first and second vane arrays each includes a plurality of vanes that each have a uniform vane thickness between leading and trailing vane surfaces, when considered in the circumferential direction.

64. The single-stage turbine fluid pump assembly of claim 50, wherein said first and second vane arrays each includes a plurality of vanes, wherein one or more of said plurality of vanes comprises a sidewall surface, a trailing vane surface and a rounded radius located therebetween.

65. The single-stage turbine fluid pump assembly of claim 64, wherein said rounded radius is uniform along its radial extent, and radially extends from said outer hub surface to said inner hoop surface.

66. The single-stage turbine fluid pump assembly of claim 64, wherein said rounded surface is at least partially defined by a radius in the range of 0.10 mm–1.50 mm.

67. The single-stage turbine fluid pump assembly of claim 66, wherein said radius is approximately 0.70 mm.

68. The single-stage turbine fluid pump assembly of claim 50, wherein said fluid pump is a fuel pump for use with a vehicle fuel delivery system.

69. The single-stage turbine fluid pump assembly of claim 50, wherein said impeller further includes an outer hoop that co-rotates with the impeller.

70. The single-stage turbine fluid pump assembly of claim 50, wherein said fluid inlet passage includes a tapered section at the point at which said passage connects to said lower annular grooves.

71. The single-stage turbine fluid pump assembly of claim 50, wherein said fluid inlet passage is designed to divert a first portion of incoming fluid into said first lower annular groove and a second portion of incoming fluid into said second lower annular groove, whereby said second portion is greater than said first portion.

72. The single-stage turbine fluid pump assembly of claim 50, wherein said fluid inlet passage has a great enough radial extent to encompass both of said first and second lower annular grooves.

73. The single-stage turbine fluid pump assembly of claim 50, wherein at least one of said first and second lower annular grooves includes an axially tapered first section that begins in the area proximate said fluid inlet passage.

74. The single-stage turbine fluid pump assembly of claim 73, wherein said first section extends for a circumferential extent of approximately 30°.

75. The single-stage turbine fluid pump assembly of claim 73, wherein one or more vent hole(s) are located proximate the end of said first section.

76. The single-stage turbine fluid pump assembly of claim 73, wherein at least one of said first and second lower annular grooves further includes an axially tapered second section that ends in the area proximate said fluid outlet passage.

77. The single-stage turbine fluid pump assembly of claim 50, wherein said first and second pumping chambers have a cross-section that is generally the same shape.

78. The single-stage turbine fluid pump assembly of claim 50, wherein said first and second pluralities of vane pockets are each an open-pocket configuration.

79. The single-stage turbine fluid pump assembly of claim 50, wherein said first and second pumping chambers are generally independent of each other.

80. A single-stage turbine fluid pump assembly, comprising:

a lower casing having a top surface that includes first and second lower annular grooves;

an upper casing having a bottom surface that includes first and second upper annular grooves;

an impeller cavity formed between said top and bottom surfaces, said cavity being in fluid communication with said first and second lower annular grooves and being in fluid communication with said first and second upper annular grooves;

an electric motor having a rotating shaft;

an impeller operably coupled to said shaft such that rotation of said shaft causes said impeller to rotate within said impeller cavity, said impeller having a first vane array with a plurality of first vane pockets that operably communicate with said first lower and upper annular grooves, and a second vane array with a plurality of second vane pockets that operably communicate with said second lower and upper annular grooves;

said first and second vane arrays communicating with said first upper and lower annular grooves and said second upper and lower annular grooves, respectively, in an axial direction, but not in a radial direction;

said pluralities of first and second vane pockets each being bounded on a radially inward side by a surface that includes a circumferentially extending ridge;

a first annular pumping chamber comprising said first lower and upper annular grooves and said first vane pockets, a second annular pumping chamber comprising said second lower and upper annular grooves and said second vane pockets;

a fluid inlet passage in one of said casings and communicating with said first and second pumping chambers adjacent one end thereof;

a fluid outlet passage in one of said casings and communicating with said first and second pumping chambers adjacent the other end thereof; and wherein rotation of said impeller causes a portion of the incoming fluid through said fluid inlet passage to enter said first and second pumping chambers, to pass independently through both said first and second pumping chambers, and to be discharged from both of said first and second pumping chambers through said fluid outlet passage at a higher fluid pressure.

81. The single-stage turbine fluid pump assembly of claim 80, wherein said ridge culminates in a point.

82. The single-stage turbine fluid pump assembly of claim 80, wherein at least one of said circumferentially extending ridges radially extends a partial distance into the corresponding vane pocket, such that generally independent upper and lower helical fluid flow patterns are formed.

83. The single-stage turbine fluid pump assembly of claim 82, wherein some fluid communication exists between said upper and lower helical fluid flow patterns.

84. The single-stage turbine fluid pump assembly of claim 82, wherein said upper helical fluid flow pattern communicates between said vane pocket and one of said upper annular grooves in an axial direction, and wherein said lower helical fluid flow pattern communicates between said vane pocket and one of said lower annular grooves in an axial direction.

85. A single-stage turbine fluid pump assembly, comprising:

a lower casing having a top surface that includes first and second lower annular grooves;

an upper casing having a bottom surface that includes first and second upper annular grooves;

an impeller cavity formed between said top and bottom surfaces, said cavity being in fluid communication with said first and second lower annular grooves and being in fluid communication with said first and second upper annular grooves;

an electric motor having a rotating shaft;

an impeller operably counted to said shaft such that rotation of said shaft causes said impeller to rotate within said impeller cavity, said impeller having a first vane array with a plurality of first vane sockets that operably communicate with said first lower and upper annular grooves, and a second vane array with a plurality of second vane pockets that operably communicate with said second lower and upper annular grooves;

wherein said first and second vane arrays each includes a plurality of vanes, wherein one or more of said plurality of vanes comprises:

i) a linear root segment extending away from an outer surface in a first direction; and ii) a curved tip segment extending away from an outer terminus of said root segment and towards an inner surface such that a line tangent to said curved tip segment extends in a second direction;

a first annular pumping chamber comprising said first lower and upper annular grooves and said first vane pockets, a second annular pumping chamber comprising said second lower and upper annular grooves and said second vane pockets;

a fluid inlet passage in one of said casings and communicating with said first and second pumping chambers adjacent one end thereof;

a fluid outlet passage in one of said casings and communicating with said first and second pumping chambers adjacent the other end thereof; and wherein rotation of said impeller causes a portion of the incoming fluid through said fluid inlet passage to enter said first and second pumping chambers, to pass independently through both said first and second pumping chambers, and to be discharged from both of said first and second pumping chambers through said fluid outlet passage at a higher fluid pressure.

86. The single-stage turbine fluid pump assembly of claim 85, wherein said frist direction is retarded with respect to said second direction (angle $\theta$) when considered in the rotation direction of said impeller.

87. The single-stage turbine fluid pump assembly of claim 86, wherein said angle $\theta$ is in the range of 0°–50°, assuming said line tangent to said curved tip segment is tangent to a point located anywhere on said curved tip segment leading surface.

88. The single-stage turbine fluid pump assembly of claim 87, wherein said angle $\theta$ is in the range of 15°–35°, assuming said line tangent to said curved tip segment is tangent to a point located at a radially outermost point on said curved tip segment.

89. The single-stage turbine fluid pump assembly of claim 85, wherein said first direction is retarded with respect to the radius of the impeller (angle $\psi$) by a certain number of degrees, when considered in the rotational direction of said impeller.

90. The single-stage turbine fluid pump assembly of claim 89, wherein said angle ψ is in the range of 2°–20°.

91. The single-stage turbine fluid pump assembly of claim 90, wherein said angle ψ is in the range of 5°–15°.

92. The single-stage turbine fluid pump assembly claim 85, wherein said second direction is advanced with respect to the radius of the impeller by a certain number of degrees, when considered in the rotational direction of said impeller.

93. The single-stage turbine fluid pump assembly of claim 92, wherein said certain number of degrees is in the range of 0°–30°, assuming said line tangent to said curved tip segment is tangent to a point located anywhere on said curved tip segment leading surface.

94. The single-stage turbine fluid pump assembly of claim 93, wherein said certain number of degrees is in the range of 10°–25°, assuming said line tangent to said curved tip segment is tangent to a point located at a radially outermost point on said curved tip segment.

95. The single-stage turbine fluid pump assembly of claim 85, wherein the point at which the leading surface of said tip segment joins said inner surface trails the point at which the leading surface of said root segment joins said outer surface by a certain number of degrees (angle β), when considered in the rotational direction of said impeller.

96. The single-stage turbine fluid pump assembly of claim 95, wherein said angle β is in the range of 0°–10°.

97. The single-stage turbine fluid pump assembly of claim 96, wherein said angle β is in the range of 0°–5°.

98. The single-stage turbine fluid pump assembly of claim 85, wherein said curved tip segment is at least partially defined by a radius having a length in the range of 1.00 mm–5.00 mm.

99. A single-stage turbine fluid pump assembly, comprising:

a lower casing having a top surface that includes first and second lower annular grooves;

an upper casing having a bottom surface that includes first and second upper annular grooves;

an impeller cavity formed between said top and bottom surfaces;

an electric motor having a rotating shaft;

an impeller operably coupled to said shaft such that rotation of said shaft causes said impeller to rotate within said impeller cavity, said impeller having a hub with a hub surface, a first vane array with a plurality of first vane pockets, a mid-hoop with first and second mid-hoop surfaces, a second vane array with a plurality of second vane pockets, and an outer hoop with an outer hoop surface;

wherein each of said plurality of first vane pockets is generally defined between said hub surface and said first mid-hoop surface, and each of said plurality of first vane pockets is open such that fluid can communicate between said first lower and upper annular grooves;

wherein each of said plurality of second vane pockets is generally defined between said second mid-hoop surface and said outer hoop surface, and each of said plurality of second vane pockets is open such that fluid can communicate between said second lower and upper grooves;

a first annular pumping chamber comprising said first lower and upper annular grooves and said first vane pockets;

a second annular pumping chamber comprising said second lower and upper annular grooves and said second vane pockets;

a fluid inlet passage in one of said casings and communicating with said first and second pumping chambers adjacent one end thereof;

a fluid outlet passage in and opening to the exterior of one of said casings and communicating with said first and second pumping chambers adjacent the other end thereof;

between said fluid inlet passage and said fluid outlet passage said first annular pumping chamber is independent of said second annular pumping chamber and not connected with said second annular pumping chamber; and wherein rotation of said impeller causes at least a portion of the incoming fluid to flow: i) through said fluid inlet passage, ii) from said fluid inlet passage into said first and second pumping chambers, iii) independently through said first and second pumping chambers, and iv) from said first and second independent pumping chambers into said fluid outlet passage, such that said portion of incoming fluid exits said fluid outlet passage at a higher fluid pressure than it entered said fluid inlet passage.

* * * * *

UNITED STATES PATENT AND TRADEMARK OFFICE

CERTIFICATE OF CORRECTION

PATENT NO. : 6,932,562 B2
DATED : August 23, 2005
INVENTOR(S) : Joseph M. Ross

It is certified that error appears in the above-identified patent and that said Letters Patent is hereby corrected as shown below:

Column 17,
Line 12, after “groove;” delete “and;”.

Column 22,
Line 13, delete “counted” and insert -- coupled --.
Line 16, delete “sockets” and insert -- pockets --.
Line 50, delete “frist” and insert -- first --.

Signed and Sealed this

Twenty-fourth Day of January, 2006

JON W. DUDAS
*Director of the United States Patent and Trademark Office*